United States Patent [19]

Osho

[11] 4,267,785

[45] May 19, 1981

[54] AUTOMATIC APPARATUS FOR FEEDING AND FITTING A GORE PIECE TO THE INSIDE THIGH OPENING OF A STOCKING MATERIAL

[75] Inventor: Takatori Osho, Nara, Japan

[73] Assignee: Takatori Machinery Works Ltd., Japan

[21] Appl. No.: 154,229

[22] Filed: May 29, 1980

[30] Foreign Application Priority Data

Jun. 21, 1979 [JP] Japan ..... 54-079525

[51] Int. Cl.[3] ..... D05B 21/00

[52] U.S. Cl. ..... 112/121.12; 112/121.15

[58] Field of Search ..... 112/121.15, 121.11, 112/121.12, 121.29; 223/112, 43

[56] References Cited

U.S. PATENT DOCUMENTS

| | | | |
|---|---|---|---|
| 2,120,251 | 10/1978 | Takatori et al. | 112/121.15 |
| 2,702,014 | 2/1955 | Brownstein | 112/121.15 |
| 3,859,938 | 1/1975 | Fukuyama | 112/121.15 |
| 4,188,898 | 2/1980 | Bell, Jr. et al. | 112/121.15 |

*Primary Examiner*—H. Hampton Hunter

*Attorney, Agent, or Firm*—Lerner, David, Littenberg & Samuel

[57] ABSTRACT

A material strip is intermittently delivered from a supply reel, gore pieces are separated one after another from the material strip after trimming into a diamond shape by means of a pair of cutters, and individual gore piece is fed and fitted, in a folded state, to the inside thigh opening of a stocking material. Fully automatic operations save labor greatly and assures reliable work.

7 Claims, 11 Drawing Figures

AUTOMATIC APPARATUS FOR FEEDING AND FITTING A GORE PIECE TO THE INSIDE THIGH OPENING OF A STOCKING MATERIAL

BACKGROUND OF THE INVENTION

The present invention relates to an automatic apparatus for feeding an fitting a gore piece to the inside thigh opening of a stocking material, and more particularly relates to an apparatus for automatically feeding and fitting, in production of a gored panty-hose, a diamond-shaped gore piece to the inside thigh opening of a stocking material.

The so-called panty-hose, which is an integral combination of a pair of stockings with a panty, is now widely used by ladies due to its excellent fit to the user's body, allowance for free action of its user, and style maintenability.

Two sorts of panty-hose are now on market, i.e. gored panty-hose and goreless panty-hose and the present invention relates to production of a gored panty-hose.

A gored panty-hose is in general comprised of a stocking material made up of a pair of tubular leg sections, and a diamond-shaped gore seamed to the inside thigh section of the stocking material.

The inventor of the present invention has already proposed an automatic system for carrying out such seaming of the gore piece.

In accordance with the automatic system, a stocking material is held with its pair of leg sections being superimposed, slicing is applied to the inside thigh section of the stocking material, sliced fringes are spread so as to be exposed outside, a gore piece cut into a diamond shape is fed and fitted to an opening defined by the sliced fringes, and the sliced fringes of the stocking material and the fringe of the gore piece are seamed together.

The series of operations are completed while a plurality of carriers, each holding a set of stocking material, travel periodically and intermittently from station to station arranged along an endless path of travel at prescribed intervals.

Feeding and fitting of the gore pieces are carried out at the third station on the above-described path of travel by cooperation of a gore piece feeding assembly with a gore piece fitting assembly. Since the carriers arrive at the third station one after another, the feeding and fitting operations has to be repeated reliably in order.

SUMMARY OF THE INVENTION

It is the object of the present invention to provide and apparatus which carries out the repeated feeding and fitting operation of gore pieces quite automatically and reliably in order.

In accordance with the present invention, a material strip if intermittently delivered from a supply source reel, gore pieces are separated one after another from the material strip after trimming into a diamond shape by means of cutters, and individual gore piece is fed and fitted, in a folded state, to the inside thigh opening defined by sliced fringes of a stocking material.

DESCRIPTION OF THE PREFERRED EMBODIMENT (i) Seaming of a gore piece

FIGS. 1A through 1F depict sequential stemps in seaming of a gore piece to which the present invention is applied.

Figure 1A:
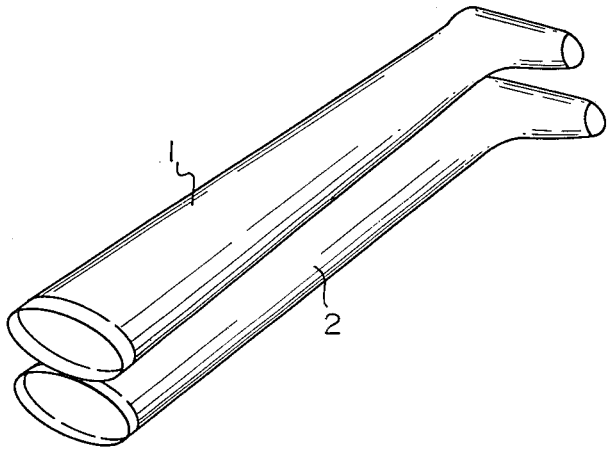
FIGS. 1A through 1F are perspective views for showing steps in seaming of a gore piece on the apparatus of the present invention.
Figure 1B:
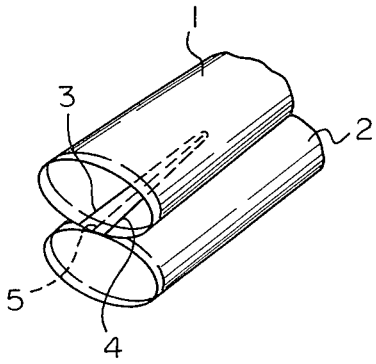

As shown in FIG. 1A, a stocking material includes a pair of tubular leg sections 1 and 2. The leg sections 1 and 2 are clamped in a superimposed state along lines 3 and 4 as shown in FIG. 2B. While keeping the clamped state, slicing is applied to the inside thigh section of the stocking material along a line 5 extending in between the clamping lines 3 and 4.

Figure 1C:
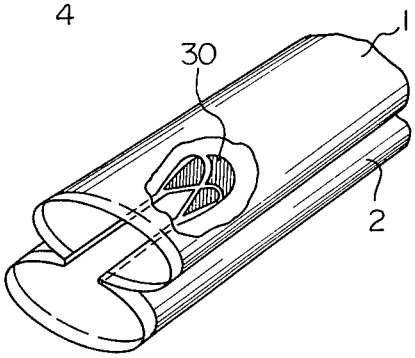

After slicing, the open ends of the leg sections of the stocking material are opened laterally in a direction substantially normal to the clamping lines 3 and 4 in order to form an opening defined by sliced fringes and a gore piece 30, which is previously trimmed into a diamond shape, is fed and fitted, in a folded state, to the inside thigh opening as shown in FIG. 1C. Thereafter, the fringe of the gore piece is seamed to the sliced fringes of the stocking material along a line parallel to the clamping lines 3 and 4 by means of two-staged seaming operations.

Figure 1D:
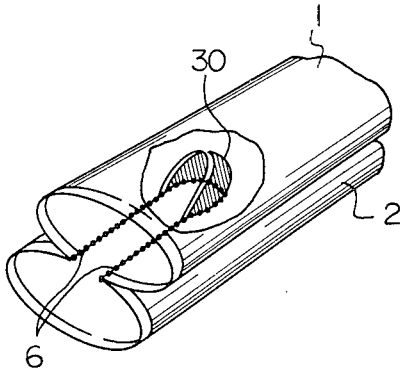
Figure 1E:
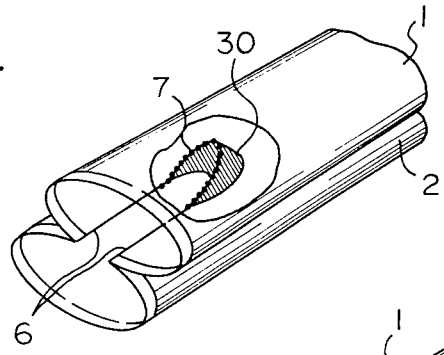
Figure 1F:
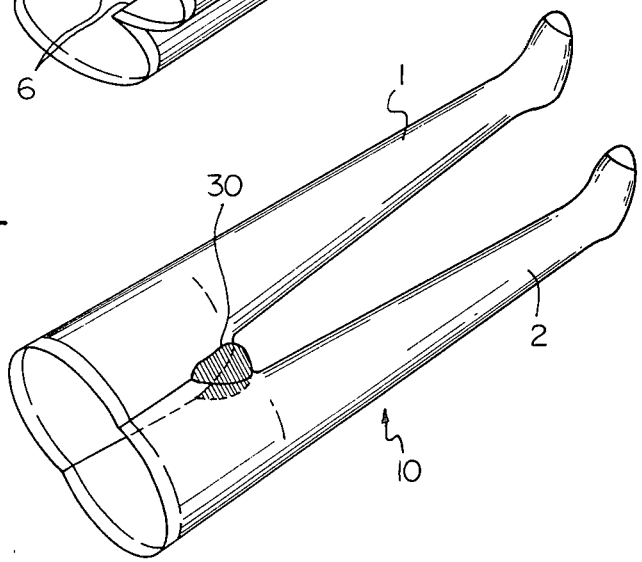

One example of the above-described sewing operations is shown in FIGS. 1D through 1F. First, as shown in FIG. 1D, a pair of sliced fringes on one side of the inside thigh opening are seamed together, one fringe of the gore piece and one sliced fringe facing the inside thigh opening are seamed together, and a pair of sliced fringes on the other side of the inside thigh opening are seamed together along seam lines 6. This is the first stage seaming operation.

Secondly, as shown in FIG. 1E, the other fringe of the gore piece and the other sliced fringe facing the inside thigh opening are seamed together in order to obtain a complete panty-hose 10 shown in FIG. 1F. This is the second stage seaming operation.

This first and second stage seaming operation are reversible.

Since the gore is located on the inside thigh section of a complete panty-hose 10, it is very difficult to seam the gore piece in position to the stocking material under the conditions shown in FIGS. 1D and 1E on sewing machines. For this reason, it is usually employed in seaming on sewing machines to clamp and spread outwards the sliced fringes in a V-shaped state beyond the straight state in order to expose them outside the stocking material. A gore piece in a folded state is fed and fitted to the inside thigh opening defined by the sliced fringes. When necessary, the clamped sliced fringes are turned inside out and seamed together with the gore piece.

(ii) Automatic panty-hose seaming machine

Figure 2:
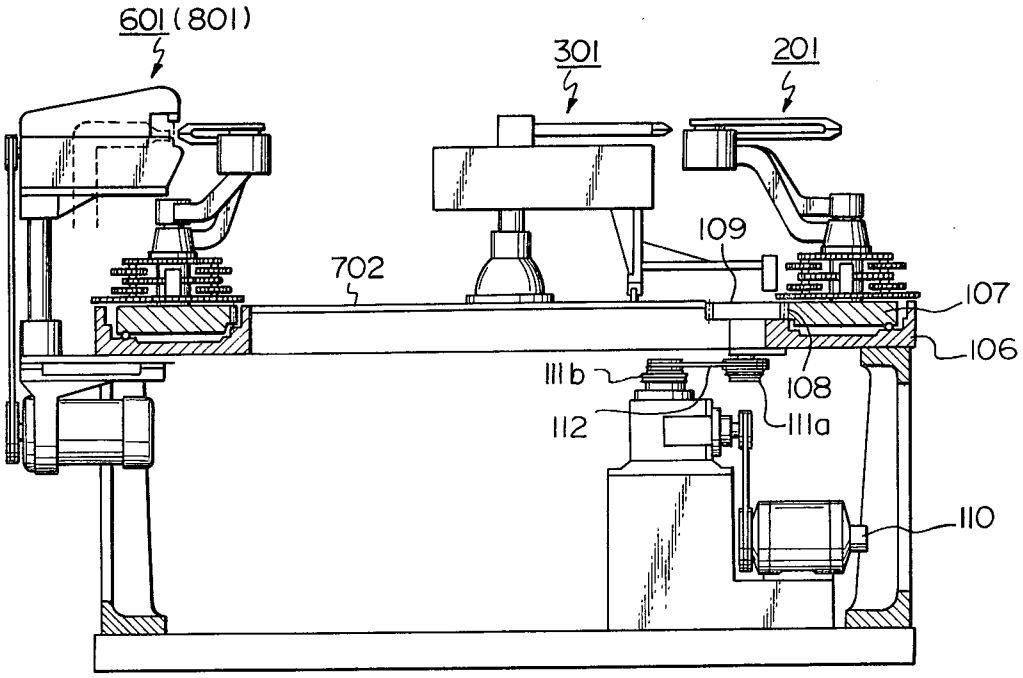
FIG. 2 is a side view of an example of an automatic panty-hose seaming machine employing the apparatus in accordance with the present invention.
Figure 3:
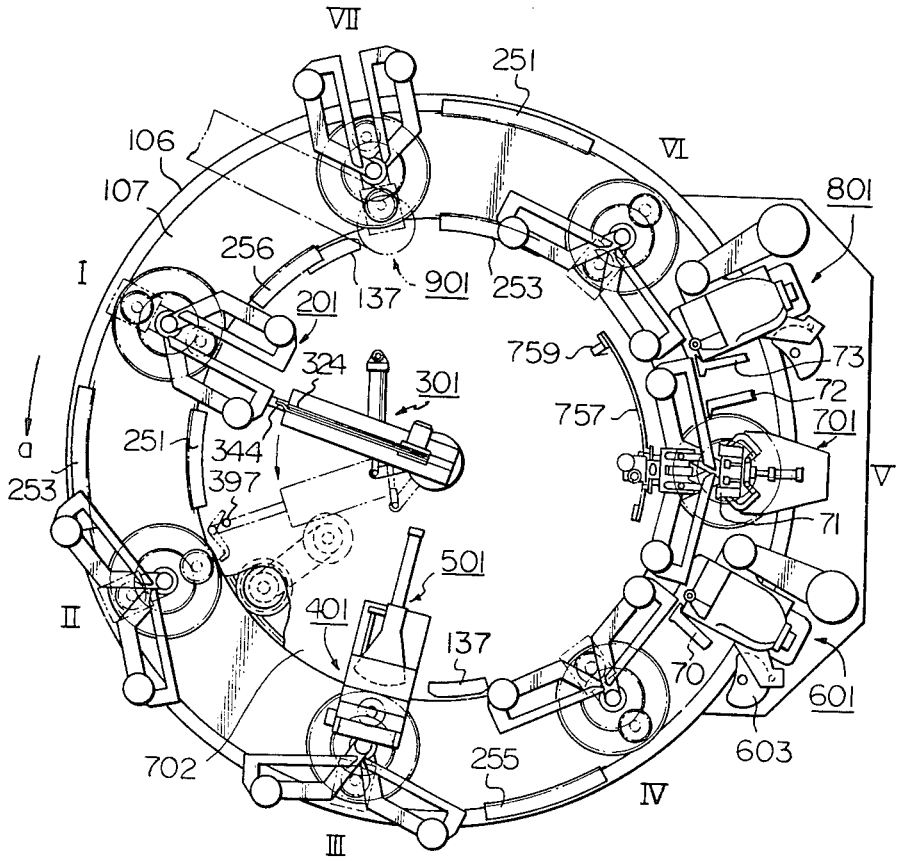
FIG. 3 is a plane view of such a machine.

One example of the automatic panty-hose seaming machine incorporating the apparatus of the present invention is shown in FIGS. 2 and 3.

A plurality of carriers 107 are arranged on a circular guide rail 106 on the pedestal of the machine at equal intervals in order to move along a circular path of travel, and each carrier 107 is provided with a pair of clampers 201. The number of the carriers 107 on the guide rail 106 and the number of clampers 201 on each carrier 201 are both chosen freely in accordance with requirement in practice.

In the case of the illustrated embodiment, seven stations I through VII are fixed along the above-described path of travel and the carriers 107 with the clampers 201 move intermittently and counterclockwise in FIG. 3 (arrow "a") in order to travel from station to station.

At the first station I, a stocking material (not shown) is set to the clamper 201 of a carrier 107 arriving at the station and held firm by the clamper 201.

During travel from the second to the third station, slicing is applied to the inside thigh section of the stocking material held by the clamper 201 by a slicing assembly 301 which is turnable following the movement of the carrier 107. Then the clamper 201 opens outwards beyond the straight state in order to expose the sliced fringes outside the stocking material.

The gore piece feeding assembly 401 and the gore piece fitting assembly 501 in accordance with the present invention are both arranged facing the third station III. A diamond-shaped gore piece 30 is fed towards the sliced fringes exposed outside the stocking material by the feeding assembly 401. At this timing, the fitting assembly 501 puts the gore piece 30 in a folded state and fits same to the inside thigh opening defined by the sliced fringes. Concurrently, the lower fringe of the folded gore piece 30 and the lower side sliced fringes are bent to be held to the lower surface of the clamper 201.

During travel from the third to fourth station, the clamper 201 in this embodiment is turned over 180 degrees in order to turn the sliced fringes of the stocking material it holds inside out so that seam lines on the stocking material and the gore piece are placed closer to the sewing machines.

During travel from the fourth to fifth station, the upper sliced fringe of the stocking material and the upper side fringe of the folded gore piece are seamed together by the first sewing machine 601.

A bending assembly 701 is arranged at the fifth station V in order to bend upwards the seamed upper sliced fringe and the upper side fringe of the gore piece. Next, the lower sliced fringe and the lower side fringe of the gore piece are both feed from the lower face of the clamper 201 for seaming-together by the second sewing machine 801.

During travel from the sixth to seventh station, the clamper 201 resumes its initial closed state and the complete panty-hose is removed off the clamper 201 by a suction type removing assembly 901 arranged at the seventh station VII.

During travel from the seventh to first station, the clamper 201 is turned over 180 degrees in order to resume its initial position. One cycle of sewing is thus completed.

(iii) The gore piece feeding and fitting assemblies

As described already, the gore piece feeding and fitting assemblies 401 and 501 are arranged facing the third station III shown in FIG. 3.

After trimming into a diamond shape by the feeding assembly 401, a gore piece 30 is provisionally held by suction, and fitted in a folded state to the inside thigh opening defined by the exposed sliced fringes by the fitting assembly 501. Concurrently with this fitting procedure, the lower side fringe of the folded gore piece and the lower sliced fringe are held by a flap at the lower face of the clamper 201.

Figure 4:
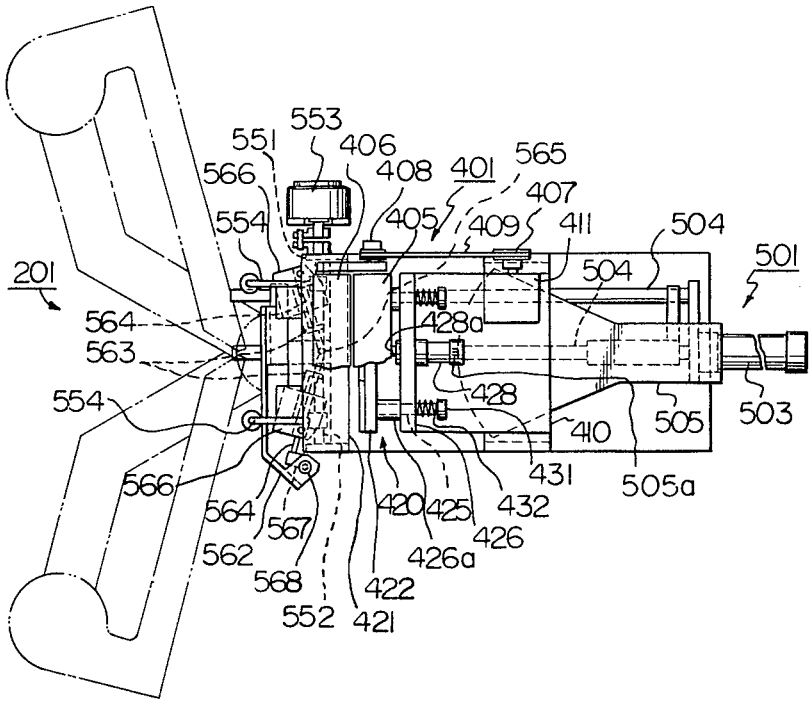
FIG. 4 is a plane view, partly removed, of one embodiment of the apparatus in accordance with the present invention.
Figure 5:
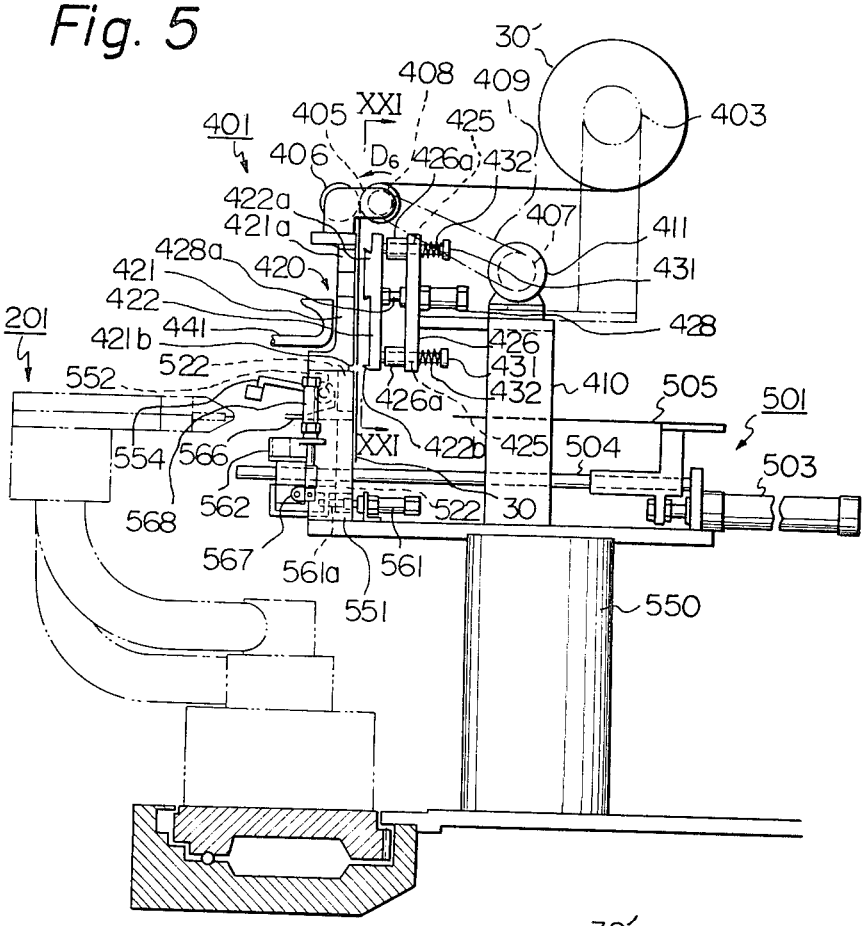
FIG. 5 is a side view of such an apparatus.
Figure 6:
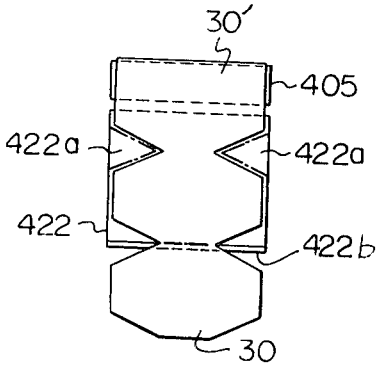
FIG. 6 is a view for showing cutting operation by cutters on the apparatus shown in FIGS. 4 and 5.

Constructions of the feeding and fitting assemblies 401 and 501 are shown in detail in FIGS. 4 and 5.

The feeding assembly 401 includes a supply reel 403 of a material strip 30' and the material strip 30' from the supply reel 403 is conducted, via a nip by a pair of delivery rollers 405 and 406, vertically and downwards towards a cutting part 420. The supply reel 403 is mounted to a bare plate 410 on a pedestal 550.

The delivery rollers are driven for intermittent rotation in a direction to deliver the material strip 30' from the supply reel 403. To this end, a drive motor 411 is mounted to the base plate 410, which rotates intermittently. One rotation of this drive motor 411 causes, via pulleys 407, 408 and a belt 409, corresponding rotation of the delivery rollers 405 and 406 over a rotation angle large enough to deliver the material strip 30' from the supply reel 403 over a length corresponding to one gore piece 30. During dwell of the rotation, the cutting part 420 operates to trim and divide a sheet gore of piece from the material strip 30'.

A pair of brackets 551 are fixed atop one end of the pedestal 550 in order to fixedly carry a stationary cutter 421. Facing stationary cutter 421, there is provided a movable cutter 422 in an arrangement able to come into snug surface contact with the stationary cutter 421. The material strip 30' is conducted vertically through the space between the both cutters 421 and 422.

On the operative surface of the movable cutter 422 facing the stationary cutter 421, a pair of laterally spaced triangular blades **422*a* are formed on the upper side. Likewise, a transverse straight blade 422*b*** is formed on the lower side.

In the operative surface of the stationary cutter 421 facing the movable cutter 422, a pair of triangular depressions 421 are formed at positions corresponding to the triangular blade **422*a* on the movable cutter 422. Likewise, a transverse straight depression 421*b* is formed at a position corresponding to the straight blade 422*b* on the movable cutter 422**.

Consequently, when two cutters 421 and 422 are placed in the snug surface contact, the blades **422*a* and 422*b* on the movable cutter 422 are brought into engagement with the depressions 421*a* and 421*b* in the stationary cutter 421**, respectively.

To the opposite surface of the movable cutter 422, a pair of vertical spaced slide shafts 425 are fixed horizontally and inserted slidable into bosses **426*a* disposed to a vertical block 426 on the base plate 410. About the middle of the space between the slide shafts 425, a pneumatic cylinder 428 is arranged with its piston rod 428*a* extending through the vertical block 426 in order to be fixed to the above-described opposite surface of the movable cutter 422. A collar 431 is fixed to the free end of each slide shaft 425 and a helical compression spring 432 is interposed between the collar 431 and the vertical block 426 whilst loosely winding around the slide shaft 425. Repulsion of the springs 432 normally urges the cutters 421 and 422** to estrange from each other.

Upon operation of the pneumatic cylinder 428, the piston rod **428*a* advances to put the movable cutter 422 into snug surface contact with the stationary cutter 421 against repulsion of the compression spring 428. As a result of this surface contact, triangular cut-outs are formed in both fringes of the material strip 30' by the triangular blades 422***a*, and a sheet of diamond shaped gore piece 30 is separated from the material strip 30' by the straight blade 422*b*.

A pair of vertical blocks 522 are arranged below the stationary cutter 421 and the gore piece 30 separated from the material strip 30' is held by suction on the vertical blocks 522 as shown in FIG. 5. To this end, each vertical block 522 has a cavitious construction connected to a given pneumatic suction source and a number of apertures formed in its surface facing the path of travel of the separated gore piece 30. A suction nozzle 441 is located near the stationary cutter 421 in order to discharge cut pieces of the material strip 30' outside the system.

The gore piece fitting assembly 501 will hereinafter be explained in more detail, which is arranged on the pedestal 550.

A pair of laterally spaced guide rods 504 are fixed horizontally on the pedestal 550 and a sector fitting element 505 is slidably mounted to the guide rods 504, which is provided at the operating end with short needles 505*a* for holding gore pieces. The fitting element 505 is driven for reciprocation along the guide rods 504 by a pneumatic cylinder 503 mounted to the pedestal 550.

The pneumatic cylinder 503 starts its operation at a timing when the sheet of diamond-shaped gore piece 30 trimmed by the feeding assembly 401 is sucked in the vertical state onto the vertical block 522. Thereupon, the fitting element 505 advances in order to fold the gore piece 30 on the vertical block 522 and fit same to the inside thigh opening defined by the sliced fringes of the stocking material.

An assembly is arranged on one end of the pedestal 550 to force the lower fringe of the folded gore piece and the lower sliced fringe be caught by the flap on the loser face of the clamper 201.

The assembly includes a pair of laterally spaced brackets 551 arranged atop the pedestal 550. The above-described pair of vertical blocks 522 are located in between these pair of brackets 551. A rotary shaft 552 is carried by the brackets 551, and coupled at one end to a rotary solenoid 553 as shown in FIG. 4. A pair of L-shaped pressors 554 are fixed to the rotary shaft 552 whilst being spaced laterally. Each pressor 554 is provided with at its free end with a highly frictional fitting.

As the rotary solenoid 553 operates, the pressors 554 swing to press the upper fringe of the gore piece 30 onto the top surface of the fitting element 505 in order to assure easy and correct sewing in the subsequent stage.

A lower leaf spring shifter 562 is slidably disposed to the front end of the guide rod 504, and coupled to the front end of the piston rod 561*a* of a pneumatic cylinder 561 fixed on the pedestal 550. A pair of channel-shaped small brackets 563 are disposed to the shifter 562 in an arrangement corresponding to the center angle between a pair of fingers of the clamper 201 in the open state. Each bracket 563 swingably carries a small rotary shaft 564. The pair of rotary shafts 564 coupled to each other by means of a universal coupling 565. A leaf spring 566 is fixed to each rotary shaft 564 by means of an arm (not shown) in order to press the lower fringe of the gore piece 30 and the lower sliced fringe of the stocking material. One of the rotary shafts 564 fixedly carries a lever 567 which is coupled to a pneumatic cylinder 568 fixed to the shifter 562.

After the fitting element 505 has completed its operation, the pneumatic cylinder 561 starts to operate in order to make the leaf springs 566 approach the lower fringe of the gore piece 30 and the lower sliced fringe. Next, the pneumatic cylinder 568 starts its operation and turns the lower fringe of the gore piece and the lower sliced fringe together with the leaf springs 566 along a circular path of travel in order to open the flap on the lower face of the clamper 201 so that the lower fringe of the gore piece and the lower sliced fringe are both caught by the flap.

As a substitute for the pneumatic cylinders used for the present invention, hydraulic cylinders may be used also.

In accordance with the present invention, a series of operations are carried out quite automatically and reliably, which includes intermittently delivering a material strip from a supply reel, trimming the material strip into separate gore pieces of a prescribed pattern, folding each gore piece and fitting the folded gore piece to the inside thigh opening defined by sliced fringes of a stocking material.

Further, in advance to the subsequent two-staged seaming operations of the gore piece with the stocking material, the group of the lower fringe of the gore piece with the lower sliced fringe is successfully separated from the group of the upper fringe of the gore piece with the upper sliced fringe, for easy and ideal seaming.

I claim:

1. An automatic apparatus for feeding and fitting a gore piece to the inside thigh opening of a stocking material comprising a pedestal arranged facing a station on the path of travel of clampers each of which holds a stocking material having an inside thigh opening defined by sliced fringes, a gore piece feeding assembly arranged on said pedestal, and a gore piece fitting assembly arranged on said pedestal for cooperation in a prescribed sequence with said feeding assembly;

said gore piece feeding assembly including a supply source of a material strip, means arranged on the downstream side of said supply source for intermittently delivering said material strip from said supply source over a length corresponding to each said gore piece per each intermittent movement, a stationary cutter arranged on the downstream side of said intermittent delivering means and having a cutting surface facing the path of travel of said material strip, a movable cutter arranged facing said stationary cutter and having on its cutting surface a pair of laterally spaced triangular blades and a transverse straight blade spaced from said triangular blades along said path of travel of said material strip, means for estranging said movable cutter always from said stationary cutter, and means for putting, at a prescribed timing, said movable cutter in smug surface contact with said stationary cutter in order to trim and separate each said gore piece of a prescribed pattern from said material strip per each said surface contact; and said gore piece fitting assembly including means arranged facing the path of travel of said gore piece on the downstream side of said cutters for holding by pneumatic suction each said gore piece in the flat state, a fitting element arranged facing said holding means, and means for driving, at a prescribed timing, said fitting element for movement in a direction substantially normal to said path of travel of said gore piece in order to fold and fit each said gore piece on said holding means to said inside thigh opening of said stocking material.

2. An automatic apparatus as claimed in claim 1 further comprising means for pressing, at a prescribed timing, one fringe of said each gore piece and one said sliced fringe to be seamed to said one fringe onto one surface of said fitting element.

3. An automatic apparatus as claimed in claim 2 further comprising means for forcing, after operation of said pressing means, the other fringe of said each gore piece and the other said sliced fringe into a flap of each said clamper.

4. An automatic apparatus as claimed in claim 1 in which said supply source takes the form of a reel on which said material strip is rolled, and said intermittent delivering means include a pair of rollers driven for intermittent rotation.

5. An automatic apparatus as claimed in claim 1 in which said enstranging means include one or more compression springs.

6. An automatic apparatus as claimed in claim 1 in which said putting and driving means are both pneumatically operated.

7. An automatic apparatus as claimed in claim 1 in which said putting and driving means are both hydraulically operated.

* * * * *